US010716720B1

(12) United States Patent
Jordan

(10) Patent No.: US 10,716,720 B1
(45) Date of Patent: Jul. 21, 2020

(54) PATIENT TRANSPORT SYSTEM

(71) Applicant: Dana Jordan, Sandpoint, ID (US)

(72) Inventor: Dana Jordan, Sandpoint, ID (US)

(73) Assignee: Harken, Incorporated, Pewaukee, WI (US)

( * ) Notice: Subject to any disclaimer, the term of this patent is extended or adjusted under 35 U.S.C. 154(b) by 740 days.

(21) Appl. No.: 14/724,603

(22) Filed: May 28, 2015

Related U.S. Application Data

(60) Provisional application No. 62/005,779, filed on May 30, 2014, provisional application No. 62/005,768, filed on May 30, 2014, provisional application No. 62/005,754, filed on May 30, 2014.

(51) Int. Cl.
*A61G 1/048* (2006.01)
*A61G 1/00* (2006.01)
*A61G 1/007* (2006.01)

(52) U.S. Cl.
CPC ..... *A61G 1/048* (2013.01); *A61G 1/00* (2013.01); *A61G 1/007* (2013.01)

(58) Field of Classification Search
CPC ..... A61G 1/00; A61G 1/007; A61G 1/048; A61G 1/013; A61G 1/04
See application file for complete search history.

(56) References Cited

U.S. PATENT DOCUMENTS 339,786 A * 4/1886 Kayes ..... A63C 17/0013 280/826
948,120 A * 2/1910 Brock ..... A61G 7/005 144/129
1,175,046 A * 3/1916 Byron ..... B62D 53/08 280/433
1,480,286 A * 1/1924 Morganstern ..... A47C 1/146 135/96
1,639,801 A * 8/1927 Heise ..... A61G 1/0212 280/32.6
1,865,757 A * 7/1932 Honsowetz ..... A47C 21/00 211/119.006
2,519,729 A * 8/1950 Alexander ..... A47C 20/043 5/617
2,650,055 A * 8/1953 Perkins ..... B60S 9/22 248/219.4
2,784,985 A * 3/1957 Schnell ..... A01D 75/265 254/420
3,020,063 A * 2/1962 Warren, Jr. ..... B62D 53/0857 280/763.1
3,100,129 A * 8/1963 Adolphson ..... A61G 13/12 297/423.22
3,222,080 A * 12/1965 Kinraide ..... A61G 1/007 280/18
3,237,215 A * 3/1966 Fried ..... A47C 20/027 5/632

(Continued)

*Primary Examiner* — Peter M. Cuomo
*Assistant Examiner* — Ifeolu A Adeboyejo
(74) *Attorney, Agent, or Firm* — Wells St. John P.S.

(57) ABSTRACT

This invention includes embodiments which disclose patient transportation devices such as toboggans or litters, which may include adjustable handle lock and positioning systems, a handle attachment and detachment system which renders the handle readily attachable and detachable to the transportation device and/or an anchor system for securing or stabilizing rescue stretchers and rescue litters when rescuing and transporting patients.

7 Claims, 14 Drawing Sheets

(56) References Cited

U.S. PATENT DOCUMENTS 3,355,186 A * 11/1967 Bradley ..... A61G 1/007 280/19
3,405,955 A * 10/1968 Schuler ..... B60S 9/08 280/475
3,789,437 A * 2/1974 Garte ..... A47C 19/12 5/114
3,890,659 A * 6/1975 Staubs ..... A61G 1/00 5/625
3,944,259 A * 3/1976 Miller ..... B60D 1/363 280/475
4,205,825 A * 6/1980 Stanford ..... B60S 9/08 254/420
4,871,183 A * 10/1989 Moss ..... B60D 1/66 280/475
5,069,465 A * 12/1991 Stryker ..... A61G 1/048 280/47.371
5,094,418 A * 3/1992 McBarnes, Jr. ..... A61G 7/0503 248/125.1
5,306,026 A * 4/1994 Jesse ..... B62B 15/00 280/18
5,497,969 A * 3/1996 Broughton ..... B60D 1/66 248/352
6,092,828 A * 7/2000 Schumacher ..... A63C 7/102 188/6
6,139,247 A * 10/2000 Wright ..... B60R 9/06 224/519
6,310,551 B1 * 10/2001 Croft ..... A61G 1/007 116/51
6,341,406 B1 * 1/2002 Beckman ..... A61G 1/048 16/113.1
6,431,505 B2 * 8/2002 Chinn ..... A61M 5/1415 248/121
6,588,774 B2 * 7/2003 Sawatzky ..... B62B 15/00 280/18
6,607,183 B1 * 8/2003 White ..... B60S 9/08 254/420
7,337,890 B2 * 3/2008 Bochonok ..... G07F 9/06 188/19
8,763,297 B2 * 7/2014 Boll ..... A01M 31/02 42/94
9,027,939 B2 * 5/2015 Love ..... B62K 27/003 280/13
9,265,677 B2 * 2/2016 Manouchehri ..... A61G 7/0507

* cited by examiner

PATIENT TRANSPORT SYSTEM

CROSS REFERENCE TO RELATED APPLICATION

This application claims priority from the following prior U.S. provisional patent applications: U.S. Provisional Patent Application No. 62/005,768; U.S. Provisional Patent Application No. 62/005,754; and U.S. Provisional Patent Application No. 62/005,779, which are hereby incorporated herein by this reference.

TECHNICAL FIELD

This invention generally relates to a patient transport system which includes an adjustable handle, a handle attachment and detachment system and/or a transport anchor system.

BACKGROUND OF THE INVENTION

Rescue stretchers and rescue litters have been used for many years for rescue operations in the outdoors and there are numerous different types and configurations of rescue stretchers, litters and toboggans. The rescue litters generally include some type of bottom support or framework for supporting the weight of the person or animal to be rescued, along with a side framework of some sort for further containing the person being rescued. The transport, litter and/or toboggan frameworks may be made in any one of a number of different types of materials or configurations, all within the scope of this invention.

There seems to be an infinite number of different circumstances, situations, terrains and environments in which the rescue or aid must occur. It is therefore important that the equipment and tools that the rescue personnel use be flexible and adaptable to as many different types of situations, circumstances and terrain as possible. It may also be important that the equipment be adaptable to the range or spectrum of sizes of the rescue personnel themselves. For example if one rescuer is five foot tall and another rescuer who may later use the same patient transport is six foot five inches tall, it would make it very difficult for one handle setting or location to work well for both rescuers. The adjustability that embodiments of this invention provide may also be desirable if the terrain is primarily uphill at times and downhill at others to provide the same rescuer more comfort during the transport.

In rescue situations it is important that rescue personnel have the maximum flexibility with the rescue equipment in order to be able to adapt to any particular situation—and there are a near infinite number of different circumstances, situations, and environments in which the rescue or aid must occur. It is therefore important that the equipment and tools that the rescue personnel use be flexible and adaptable to as many different types of situations and circumstances as possible.

In the rescue space or environment, whether toboggans, litters or stretchers (to name a few) are used in the rescue effort, there is sometimes a need for handles and other times there is not a need for handles and handles might get in the way. It would therefore be desirable in achieving maximum flexibility for the equipment and the use of the equipment, such as the use of toboggans, that a device be provided which may but need not have a handle attached thereto. These handles are preferably attachable and detachable in a relatively easy manner and without requiring special tools and more time than is desirable under rescue situations. The handles are placed under severe stress in many working conditions and must have a high strength and not be subject to easy bending or breakage.

There are numerous situations that are encountered in the use of litters and toboggans in which the litter or toboggan must be stabilized, anchored and/or secured in order to load the patient. Without some type of easily usable anchoring or securing system, the toboggan or litter will tend to slide down the slope or run away while the rescuer is assessing the situation, providing first aid to the patient and/or loading the patient.

While the preferred embodiment for a toboggan application is shown and described, this invention is by no means limited to application on or in combination with the toboggan, but instead may be used with other rescue devices such as litters, stretchers and other devices performing these functions in rescue efforts. This accessory for rescue devices such as toboggans and litters can be attached to any type of patient transport device which is utilized in a scenario in which it might slide or slip away, whether in snow, ice, dirt, wet grass or other ground environments which may be encountered.

It is therefore an object of some embodiments of this invention to provide a handle or handle mechanism which can be attached and detached (or installed, removed and reinstalled) relatively easily.

It is also an object of embodiments of this invention to provide such a handle mechanism which can bear the harsh environment and working conditions that toboggans, stretchers, litters and other rescue equipment must endure, but yet be detached for storage, transport and other applications.

Embodiments of this invention provide such a handle mechanism which can be attached and detached from a toboggan for example, but which provide a robust handle attachment to the toboggan.

It is also an object of embodiments of this invention to provide an adjustable handle lock framework which provides greater flexibility and compensation for a variety of terrains and individual rescue personnel.

It is further an object of embodiments of this invention to provide a patient transport anchoring system or device which may be utilized on or in combination with patient transport devices (including without limitation, toboggans, litters, stretchers and others), which provides a readily usable means of anchoring the transport device so that it will not slip away while rescue, first aid and other efforts are ongoing.

It is also an object of embodiments of this invention to provide such a patient transport anchoring system which may be attached to a patient transport device.

While the invention was motivated in addressing some objectives, it is in no way so limited. The invention is only limited by the accompanying claims as literally worded, without interpretative or other limiting reference to the specification, and in accordance with the doctrine of equivalents. Other objects, features, and advantages of this invention will appear from the specification, claims, and accompanying drawings which form a part hereof. In carrying out the objects of this invention, it is to be understood that its essential features are susceptible to change in design and structural arrangement, with only one practical and preferred embodiment being illustrated in the accompanying drawings, as required.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an" and "the" as used in the claims herein are used in conformance with long-standing claim drafting practice and not in a limiting way. Unless specifically set forth herein, the terms "a", "an" and "the" are not limited to one of such elements, but instead mean "at least one".

Figure 1:
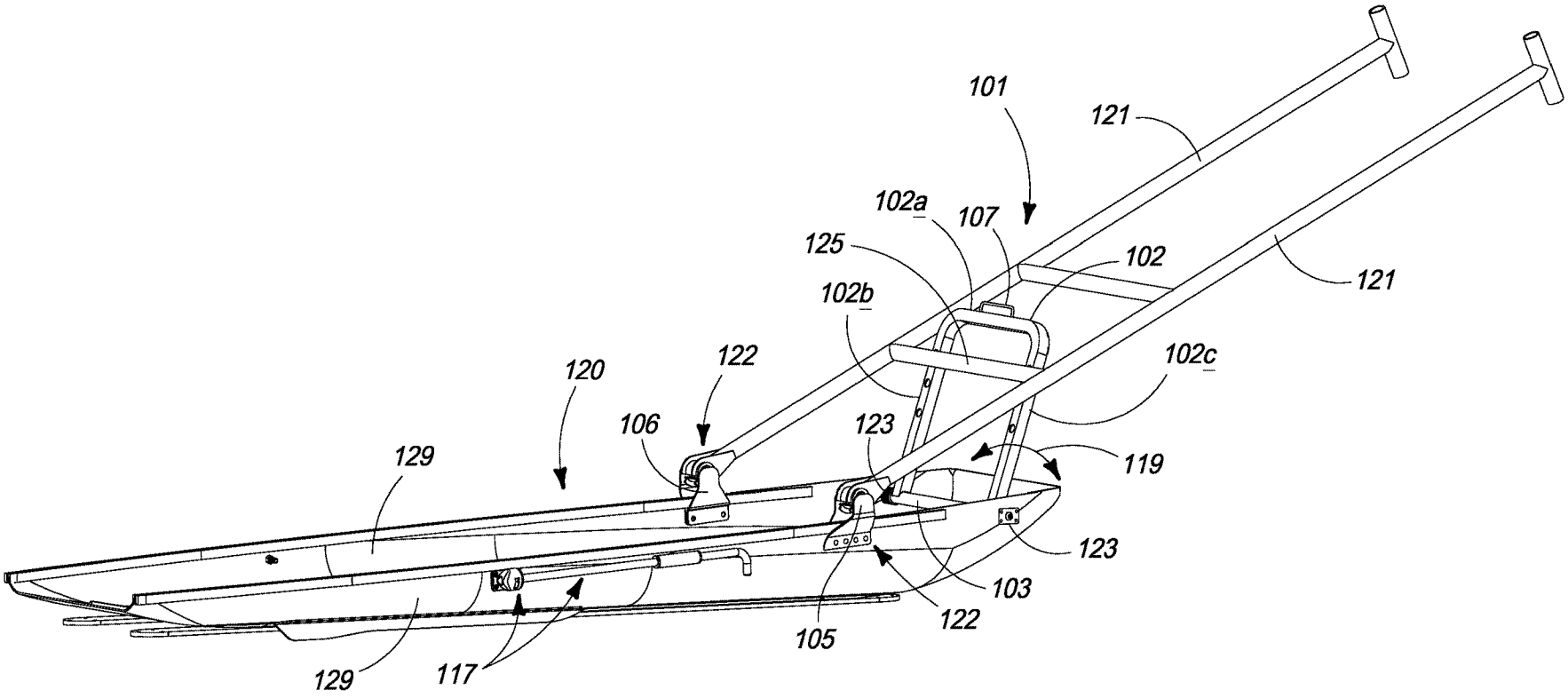
FIG. 1 a perspective view of an example of an embodiment of a patient transportation system contemplated by this invention, with an adjustable handle.

FIG. 1 is an elevation view of an embodiment of this invention, namely a rescue or patient transport system 120 (a toboggan based embodiment in this example), on which embodiments of this invention may be mounted and used, and/or which may be used in combination with embodiments of this invention. FIG. 1 illustrates toboggan 129, toboggan handle 121, along with the anchor system 117 attached to the side of the toboggan 120.

FIG. 1 also illustrates one example of an embodiment of an adjustable handle lock framework 101 mounted on the toboggan that may be utilized in practicing the invention. FIG. 1 shows handle lock framework 102 which in this embodiment is a U-shaped framework 102 with a top frame section 102*a*, a first side frame section 102*b*, a second side frame section 102*c* and a bottom or base frame section 103.

FIG. 1 further illustrates an example of a handle attachment and detachment system 122 which renders the handle readily attachable and detachable to the transportation device, as shown and described more fully in FIGS. 7-13.

Figure 2:
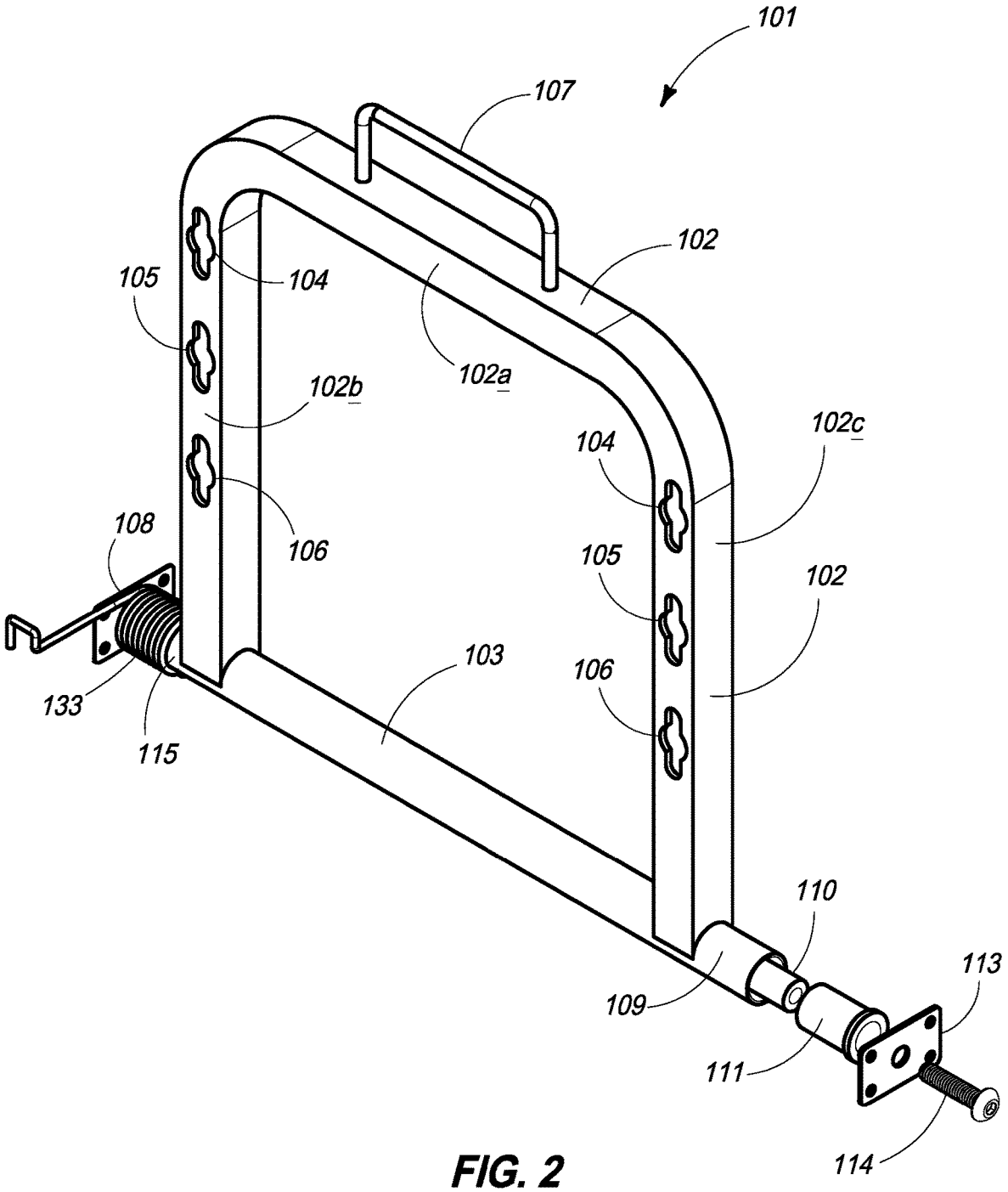
FIG. 2 is a perspective view of one example of an embodiment of an adjustable handle lock framework that may be utilized in practicing the invention.

At predetermined or corresponding locations in the first side frame section 102*b* and the second side frame section 102*c*, this embodiment shows three pairs of support apertures 104, 105 and 106 respectively (more fully shown in FIG. 2).

FIG. 2 illustrates handle 107 fixed to the top frame section 102*a* of framework 102, outside mount plates 108 and 113, cap screw 114, axle bearing 111, axle rod 110 and axle rod support frames 109 and 115. Spring 133 may be utilized as shown to provide a bias force on the framework to help keep the framework 102 positioned against the handle (shown in FIG. 3 as one example) to keep the studs 139 illustrated in FIG. 6 within the support apertures 104, 105 and 106.

The support apertures 104 (one on first frame section 102*a* and a second support aperture 104 on second frame section 102*b*) are at corresponding locations on the respective frame sections and configured as such to receive support studs or pegs (such as studs 139 shown in FIG. 6) which are integral with a patient transportation device. The configuration of pairs of support apertures 104, 105 and 106 will allow the rescue personnel to align a select pair of support apertures with the support studs or pegs on the patient transportation device to carry the patient transportation device.

FIG. 2 is an elevation view of the example of the adjustable handle lock framework 101 illustrated in FIG. 1, showing handle lock framework 102, which in this embodiment is a U-shaped framework 102 with a top frame section 102*a*, a first side frame section 102*b*, a second side frame section 102*c* and a bottom or base frame section 103. At predetermined or corresponding locations in the first side frame section 102*b* and the second side frame section 102*c*, this embodiment shows three support apertures 104, 105 and 106 respectively. Handle 107 is shown attached to top frame section 102*a*.

The support apertures 104 (one on first frame section 102*a* and a second support aperture 104 on second frame section 102*b*) are at corresponding locations on the respective frame sections and configured as such to receive support studs or pegs which are integral with a patient transportation device. The configuration of pairs of support apertures 104, 105 and 106 will allow the rescue personnel to align a selected pair of support apertures with the support studs or pegs on the patient transportation device to carry the patient transportation device.

Figure 3:
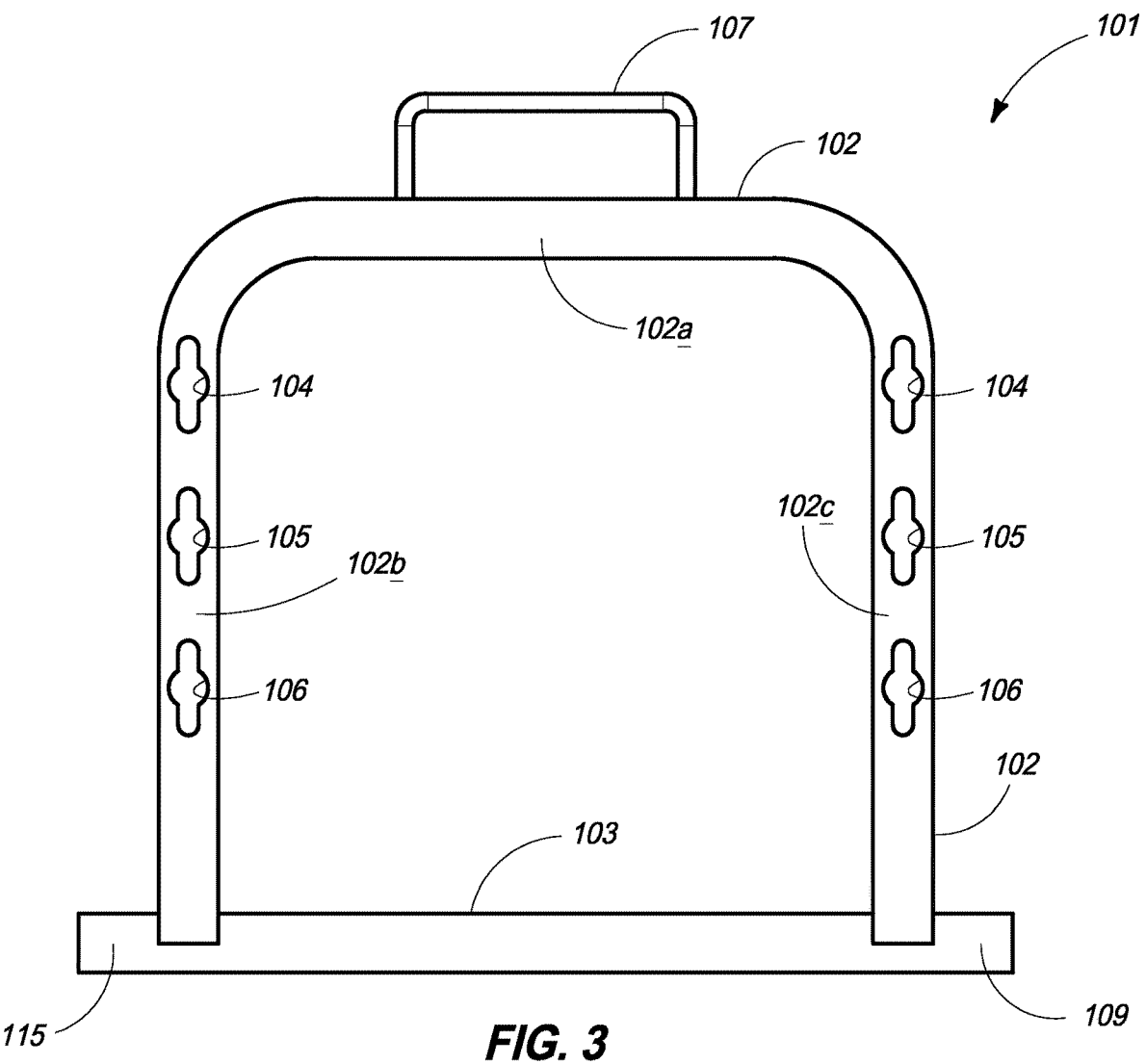
FIG. 3 is a side view of the example of the adjustable handle lock framework illustrated in FIG. 1.

FIG. 3 is an elevation view of the example of the embodiment of the adjustable handle lock framework 101 illustrated in FIG. 1 assembled within and attached to a patient transportation device 120 (a toboggan). The transport handle 121 is shown pivotally attached to the toboggan 120 body at pivotal attachment points, and the adjustable handle lock framework 101 pivotally attached to the toboggan body at attachment points 123 via outside mount plates such as those outside mount plates 108 & 113 shown and described in FIG. 2 above. The patient transportation device handle 121 can be pivoted up or down and studs in handle crossbar 124 may be inserted into one of the three pairs of corresponding support apertures 104, 105 and 106, depending on the desired height of the handle 121.

As illustrated in FIG. 3, the handle lock framework 102 has a first end pivotally mounted to the patient transportation device 120, the handle lock framework 102 including a plurality of stud apertures each configured to receive the at least one stud (shown in FIG. 6) on the handle framework, with each stud aperture being positioned up the handle lock framework 102 progressively away from the patient transportation device 120 such that positioning the at least one stud in progressively further stud apertures secures the handle framework in different higher positions for use.

Figure 6:
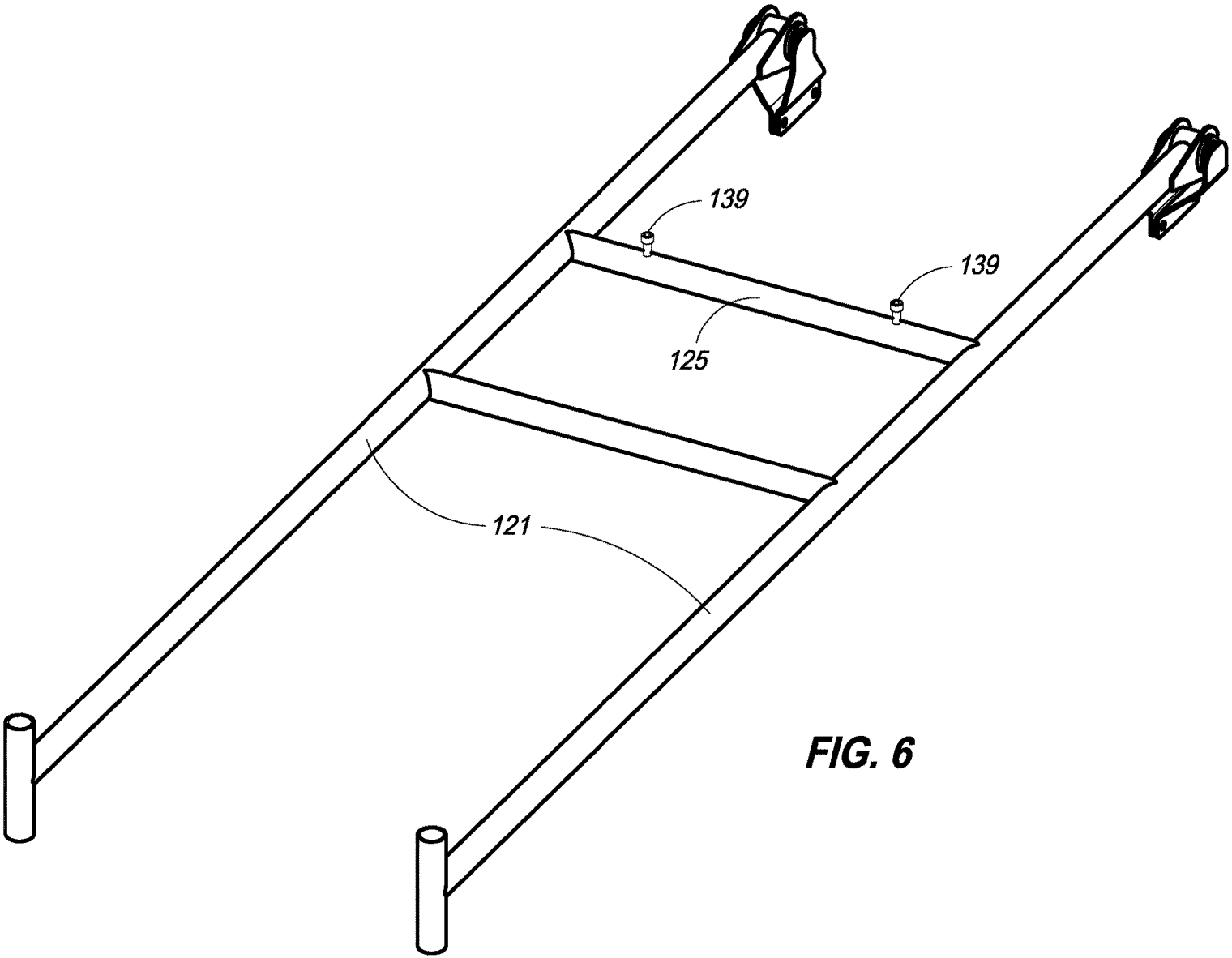
FIG. 6 is a rear perspective view illustrating the handle portion of the patient transportation device with studs therein which insert into apertures in the handle lock framework.

It is noted that while it may be preferred to mount two studs on the crossbar 125 of handle framework 121 as shown in FIG. 6, this invention is not limited to any particular number of studs or stud apertures. For example one stud may be utilized and similarly three studs may be utilized, or one or more pairs of studs may be utilized within the contemplation of this invention with no one number being required to practice this invention.

Figure 4:
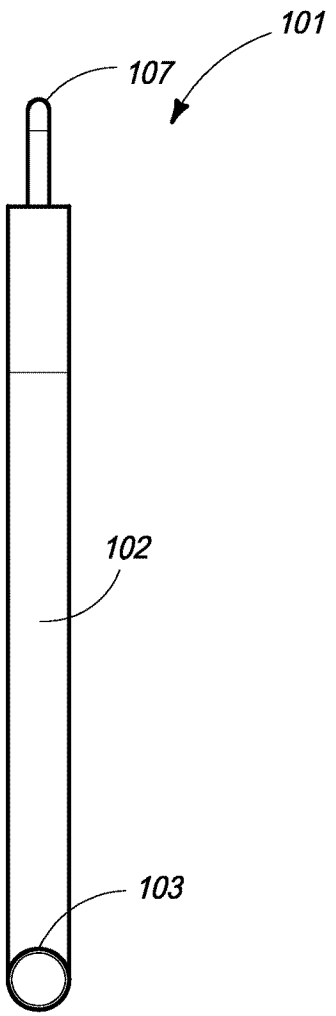
FIG. 4 is an elevation view of the example of the adjustable handle lock framework illustrated in FIG. 1.

FIG. 4 is a side view of the example of the adjustable handle lock framework 101 illustrated in FIG. 1, showing handle lock framework 102, and a bottom or base frame section 103, with handle 107 attached to the framework 102.

Figure 5:
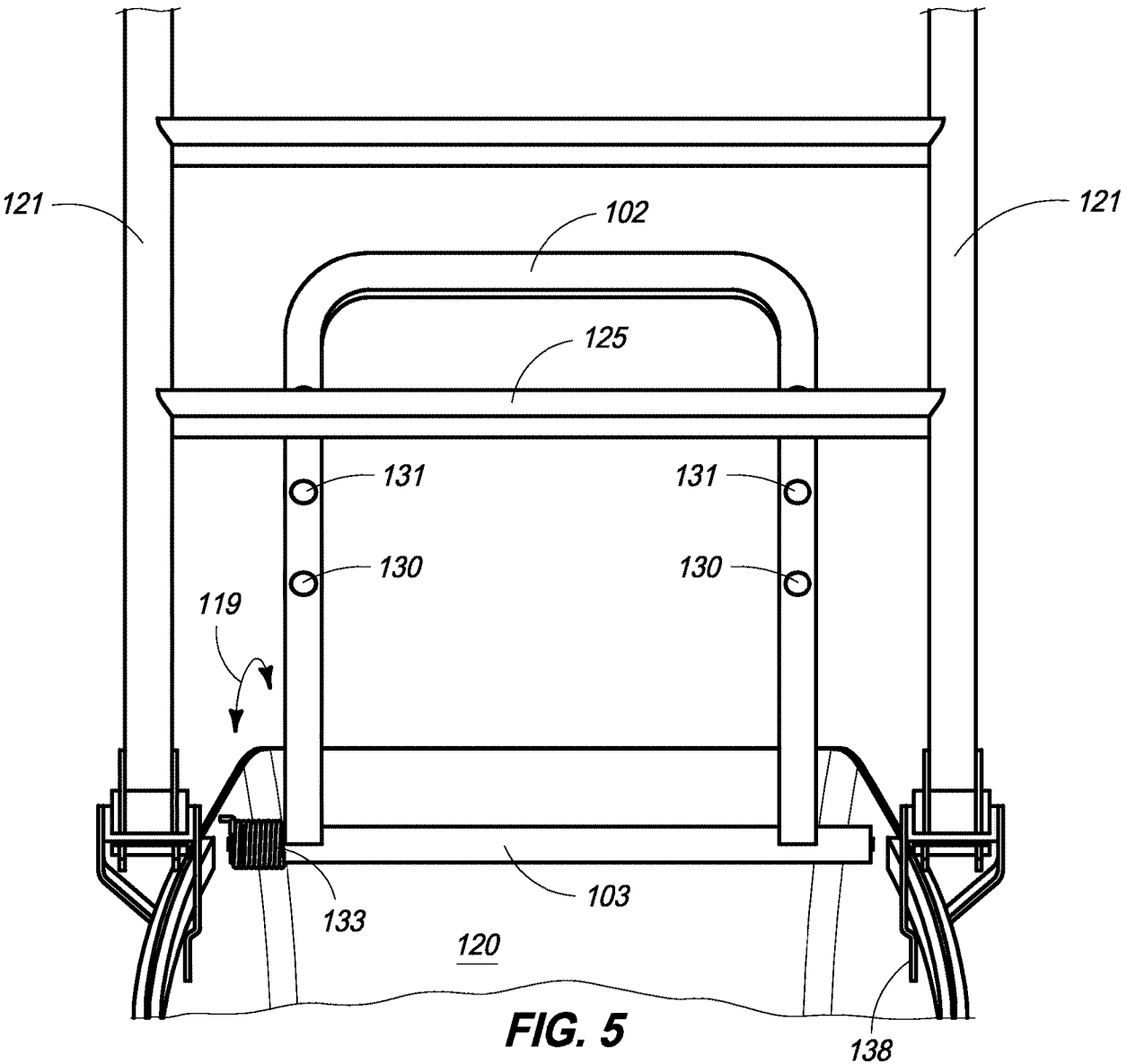
FIG. 5 is a front elevation view of the adjustable handle lock framework illustrated in prior Figures as shown as used in connection with a patient transportation device.

FIG. 5 is a front elevation view of the adjustable handle lock framework illustrated in prior figures as shown as used in connection with a patient transportation device 120, illustrating patient transportation device handle 121, spring 133, support apertures 130 and 131, handle lock framework 102, with arrow 119 showing how the handle lock framework 102 pivots about its axis to keep it biased toward the device handle 121. Not visible from this view would be studs on device handle 121 inserted within support apertures not visible behind the crossbar 125 of device handle 121.

FIG. 6 is a rear perspective view illustrating the handle component 121 of a patient transportation device with studs 139 or nubs attached or mounted thereto on crossbar 125 of the handle component 125. The studs 139 would insert into support apertures (illustrated in prior figures) as part of the handle lock framework.

It will be appreciated by those of ordinary skill in the art that if the patient transportation device handle is removed or not present, the spring bias aspect of the handle lock framework may force and retain the handle lock framework in a position abutted against the patient transportation device.

Figure 7:
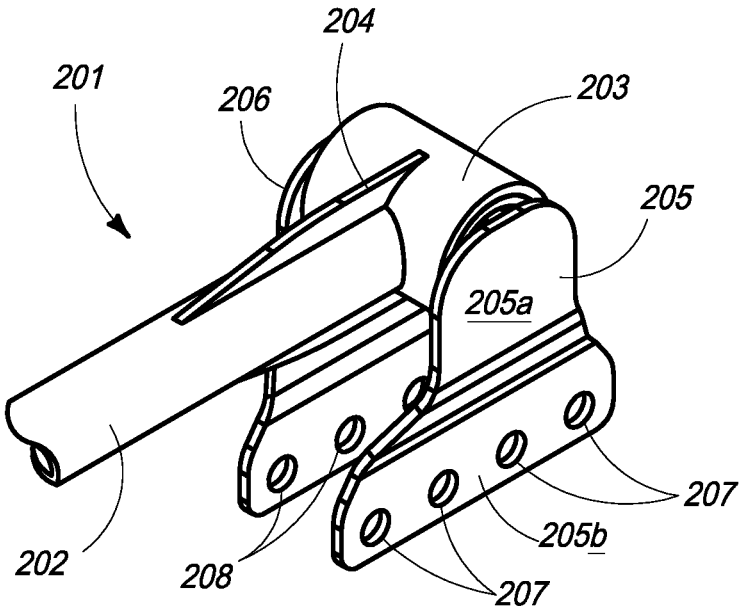
FIG. 7 is a perspective view of one example of a patient transport handle which may be used in practicing embodiments of this invention.

FIG. 7 is a perspective view of one example of a handle attachment and detachment system which may be used in a patient transportation device, showing a transport handle 201 which may be used in practicing embodiments of this invention, illustrating first framework segment 205, second framework segment 206, handle 202 with handle adapter 203 and stiffener structure 204. First framework segment 205 includes an upper portion 205*a* and a lower portion 205*b*, with the lower portion in this embodiment having a plurality of fastener holes 207, with FIG. 7 also showing a plurality of fastener holes 208 in second framework segment 206.

Figure 8:
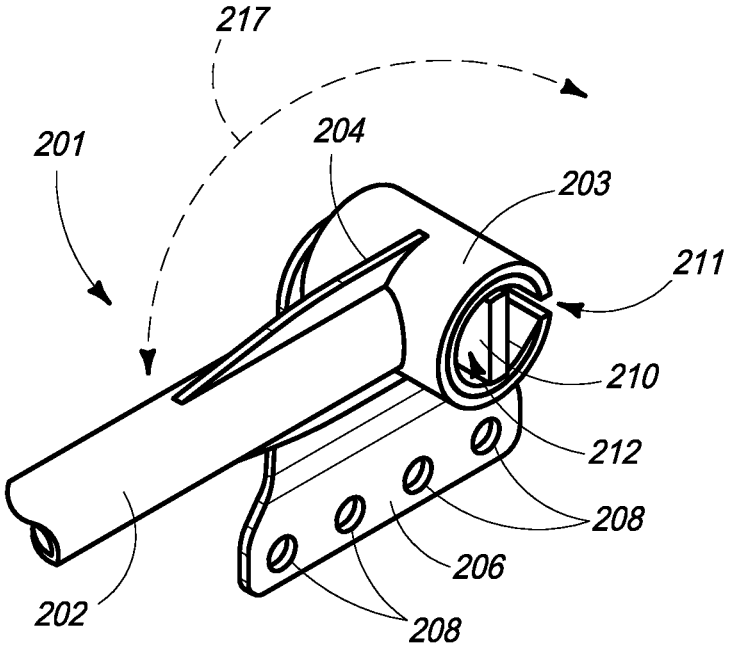
FIG. 8 is a perspective view of the example of the embodiment of this invention illustrated in FIG. 7, with one of the two framework segments removed to better view the handle configuration.

FIG. 8 is a perspective view of the example of the embodiment of this invention 201 illustrated in FIG. 7, with the first framework segment 205 (shown in FIG. 7) removed to allow a better view of the handle configuration. FIG. 8 illustrates second framework segment 206 with a plurality of fastener holes 208 or apertures, handle 202 with handle adapter portion 203 and handle stiffener 204.

FIG. 8 shows handle 202 in a usable position relative to second framework segment 206. The handle adapter portion 203 in this embodiment is generally circular with slit or bar gap 211 contained therein. The framework attachment bar 210 is shown within handle adapter portion 203 cavity 212 providing support and the point of attachment for handle 202. The framework attachment bar 210 is secured or attached to second framework segment 206 and similarly would be attached to first framework segment 205 if it were in this figure. Framework attachment bar 210 is elongated and it's width corresponds to and is less than the width of bar gap 211 in handle adapter portion 203 such that if handle 202 is rotated approximately 90° upwardly or clockwise, the bar gap 211 in handle adapter portion 203 could be slid around and off framework attachment bar 210, thereby removing the handle 202 from the framework.

It should be noted that the framework attachment bar 210 provides an axis about which the handle rotates and also acts in some ways as an axle though the embodiments shown in the figures is not the typically round shape of a more traditional axle. Furthermore the framework attachment bar movably allows for the attachment of the handle 202 relative to the attachment bar and therefore also relative to the patient transportation device to which it is attached. It should also be noted that there is no particular shape required for the framework attachment bar 210, but instead any one of a number of different shapes and configurations may be utilized within the scope of practicing embodiments of this invention.

The ability to attach or engage handle 202 the framework which includes first framework segment 205 and second framework segment 206 (interconnected by framework attachment bar 210), allows the rescue personnel the option of separately transporting or carrying handle 202 from its attachment framework which allows its attachment to the rescue toboggan or litter.

Arrow 217 illustrates how handle 202 may be pivoted about framework attachment bar 210 to allow to be moved from the position shown in FIG. 8 to a position approximately 180° from the shown position, thereby further providing flexibility to the users on which side the actual handle 202 is located relative to its framework and point of attachment to the rescue device.

Positions at which the attachment bar gap 211 is not aligned with the attachment bar 210 are use positions as the attachment bar 210 is surrounded by the perimeter of the handle adapter 203 housing. The handle and/or handle adapter is in the insertion/removal position when the attachment bar gap 211 in the handle adapter is aligned with the attachment bar such that the attachment bar gap 211 in the handle adapter 203 may be slid or moved over the attachment bar 210 thereby inserting the attachment bar 210 into the interior cavity of the handle adapter 203, or removing the attachment bar 210 from the interior cavity of the handle adapter 203.

While the framework attachment bar 210 is shown in a rectangular cross-section configuration, it may be other shapes and configurations so long as it corresponds to bar gap 211 to allow the handle 202 to be removed in this embodiment of the invention. There may be other embodiments wherein the slit or bar gap may be covered or bridge over so that handle 202 cannot be easily removed or detached from its framework, all within the contemplation of this invention.

Figure 9:
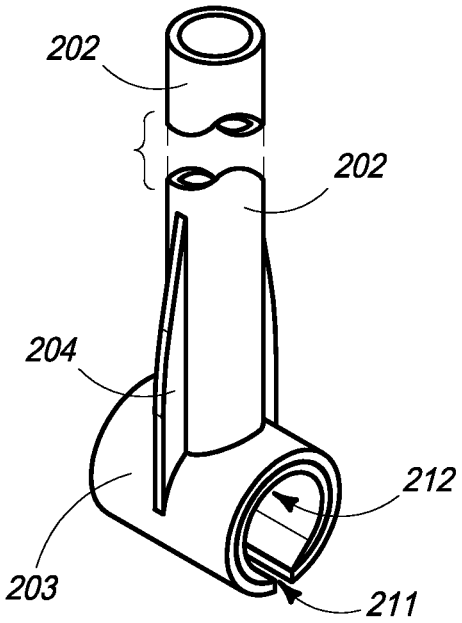
FIG. 9 is an exploded perspective view of the handle portion of the embodiment of the invention illustrated in FIG. 7.

FIG. 9 is an exploded perspective view of the handle portion 202 of the embodiment of the invention illustrated in FIG. 7, showing handle 202, handle adapter portion 203, stiffener 204, bar gap 211 in handle adapter portion 203 and handle adapter portion aperture 212 which becomes an axis about which handle 202 may be rotated around framework attachment bar 210 (shown in other figures).

Figure 10:
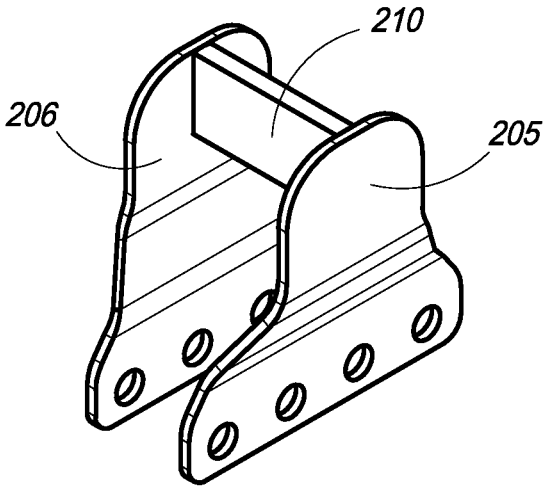
FIG. 10 is a perspective view of the attachment portion of the handle system of the embodiment of the invention illustrated in FIG. 7.

FIG. 10 is a perspective view of the framework portion of the handle system of the embodiment of the invention illustrated in FIG. 7, showing first framework segment 205, second framework segment 206 interconnected by framework attachment bar 210 which is connected to both the first framework segment 205 and the second framework segment 206. The framework attachment bar 210, in this embodiment of the invention, is sized corresponding to the generally circular handle adapter portion 203 such that when the framework attachment bar 210 is inserted into handle adapter aperture 212 and the handle 202 is rotated or pivoted, the framework attachment bar 210 substantially fills the handle adapter aperture 212 to sufficiently and movably attach and secure the handle 202 relative to the framework attachment bar 210. It is therefore desirable in embodiments of this invention to size the framework attachment bar 210, or crossbar, big enough to substantially fill the handle adapter portion 203 aperture 212 so that the handle 202 does not have an unacceptably high amount of lateral movement when in a rotated position such as shown in FIG. 7.

The framework attachment bar 210 also having a thinner dimension as shown allows the handle 202 to be attached and detached by sliding framework attachment bar 210 into bar gap 211 and handle adapter portion 203.

Figure 11:
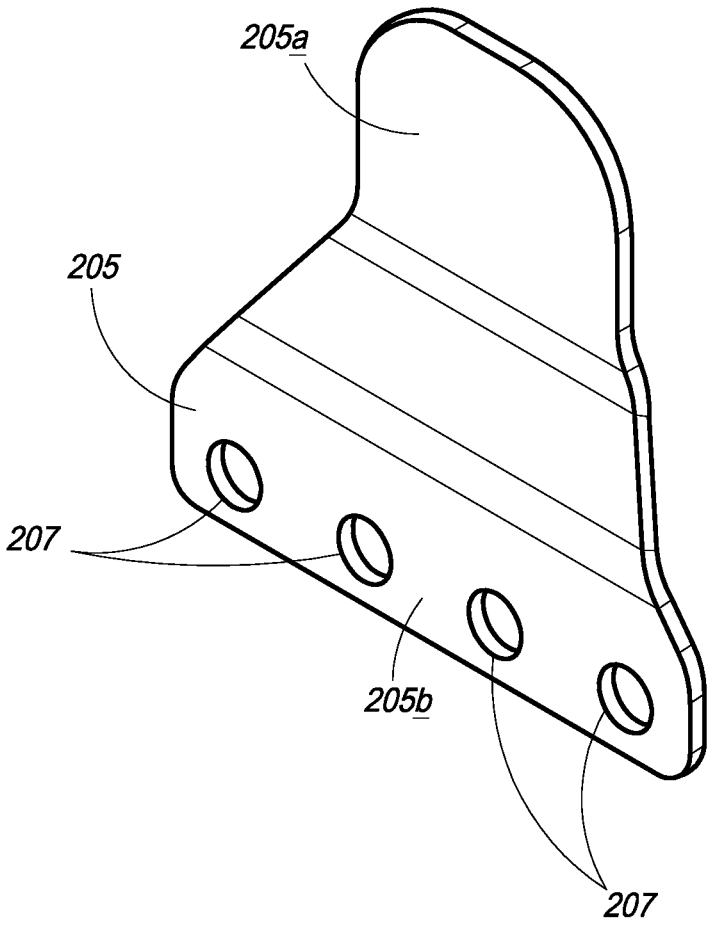
FIG. 11 is a perspective view of a first framework segment of the handle system of the embodiment of the invention illustrated in FIG. 7.

FIG. 11 is a perspective view of the first framework segment 205 of the handle framework of the embodiment of the invention illustrated in FIG. 7, showing the upper portion 205*a* and the lower portion 205*b* of first framework segment 205, with the lower portion 205*b* in this embodiment having a plurality of fastener holes 207 available to insert fasteners through to secure the framework to a rescue device such as a toboggan or litter. It will be noted that no specific configuration of framework is required to practice this invention; however, the bent portion of the first framework segment 205 illustrated in FIG. 11 would allow for the lower portion 205*b* of the framework to be adapted to a narrower framework or point of attachment on a rescue device while still providing sufficient room for a framework attachment bar to be mounted or attached to the upper portion of first framework segment 205 and corresponding second and opposing framework segment (such as illustrated in FIG. 7).

FIG. 1 also shows an elevation view of an example of an embodiment of a handle system 122 attached to a portable patient device 120 such as a toboggan as contemplated by this invention. The toboggan handle 121 has a framework and has two attachment points where it is pivotally attached to the toboggan 120. The first framework segment 105 and second framework segment 106 are shown attached to the toboggan 120 and to which the first and second toboggan handle segments are pivotally and removably attached in the way shown in the figures.

Figure 12:
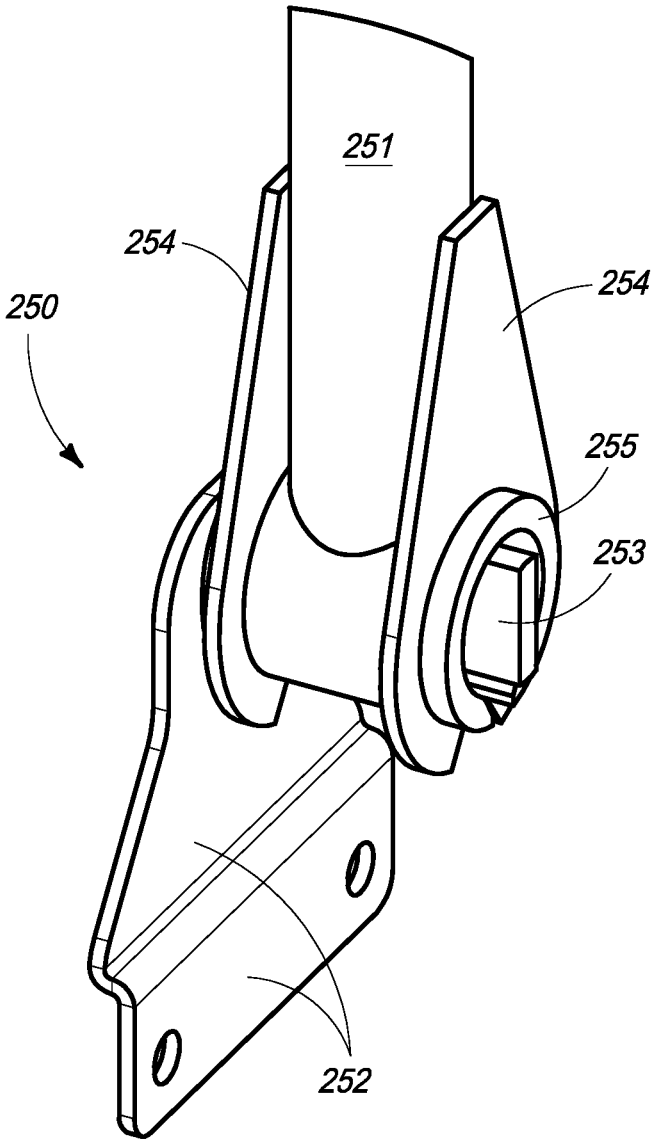
FIG. 12 is a perspective view of another example of an embodiment of the handle system contemplated by this invention.

FIG. 12 is a perspective of another example of an embodiment of the handle system 250 contemplated by this invention, illustrating handle 251, handle adapter supports 254 or framework, handle adapter 255, attachment bar 253, and first framework segment 252.

Figure 13:
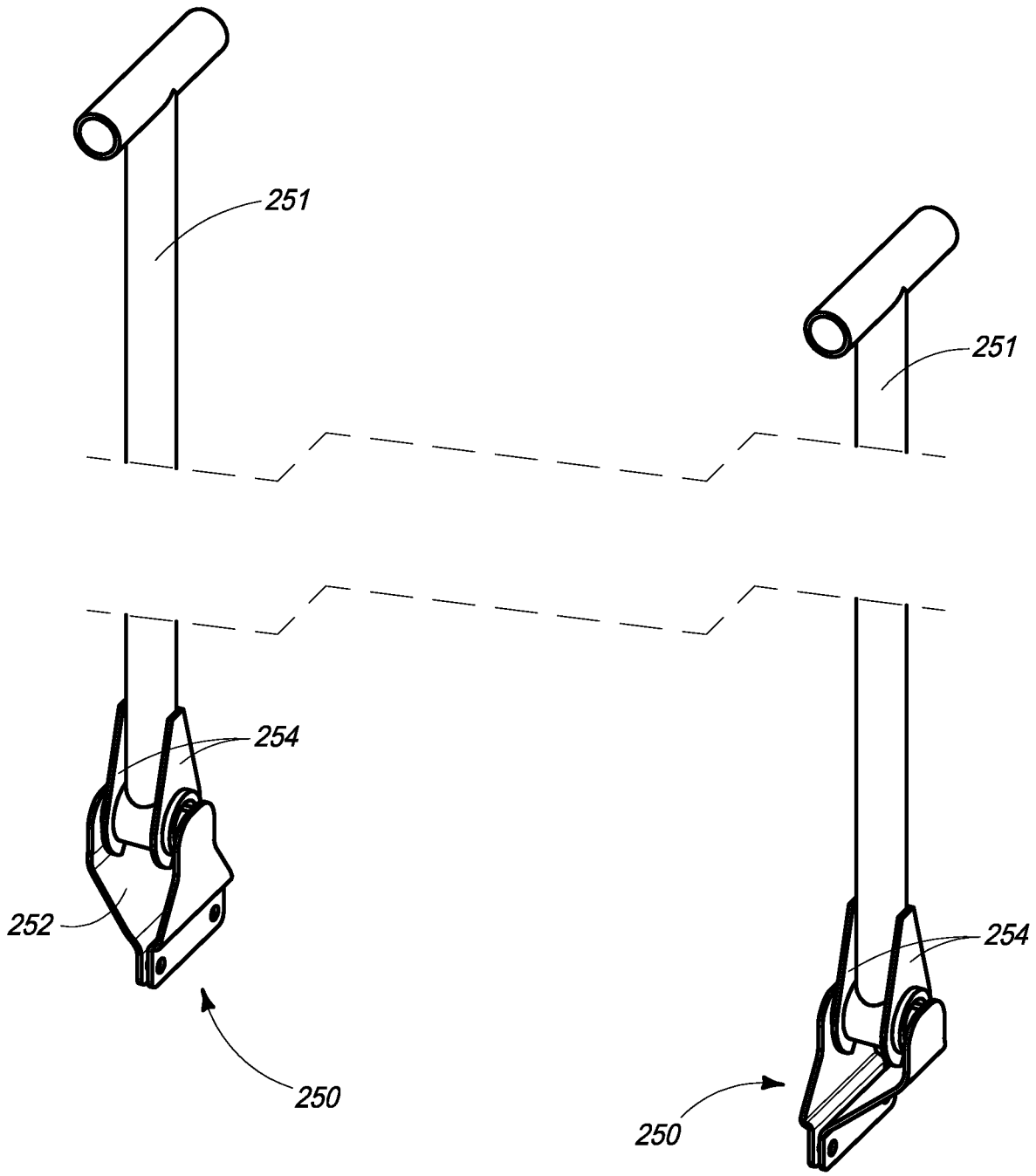
FIG. 13 is a perspective view of a handle system utilizing the example of the handle components shown in FIG. 12.

FIG. 13 is a perspective view of examples of the different handle system 250 configuration illustrated in FIG. 12, which may be utilized in embodiments of this invention, illustrating handle 251, handle adapter supports 254 or framework, and first framework segment 252.

Figure 14:
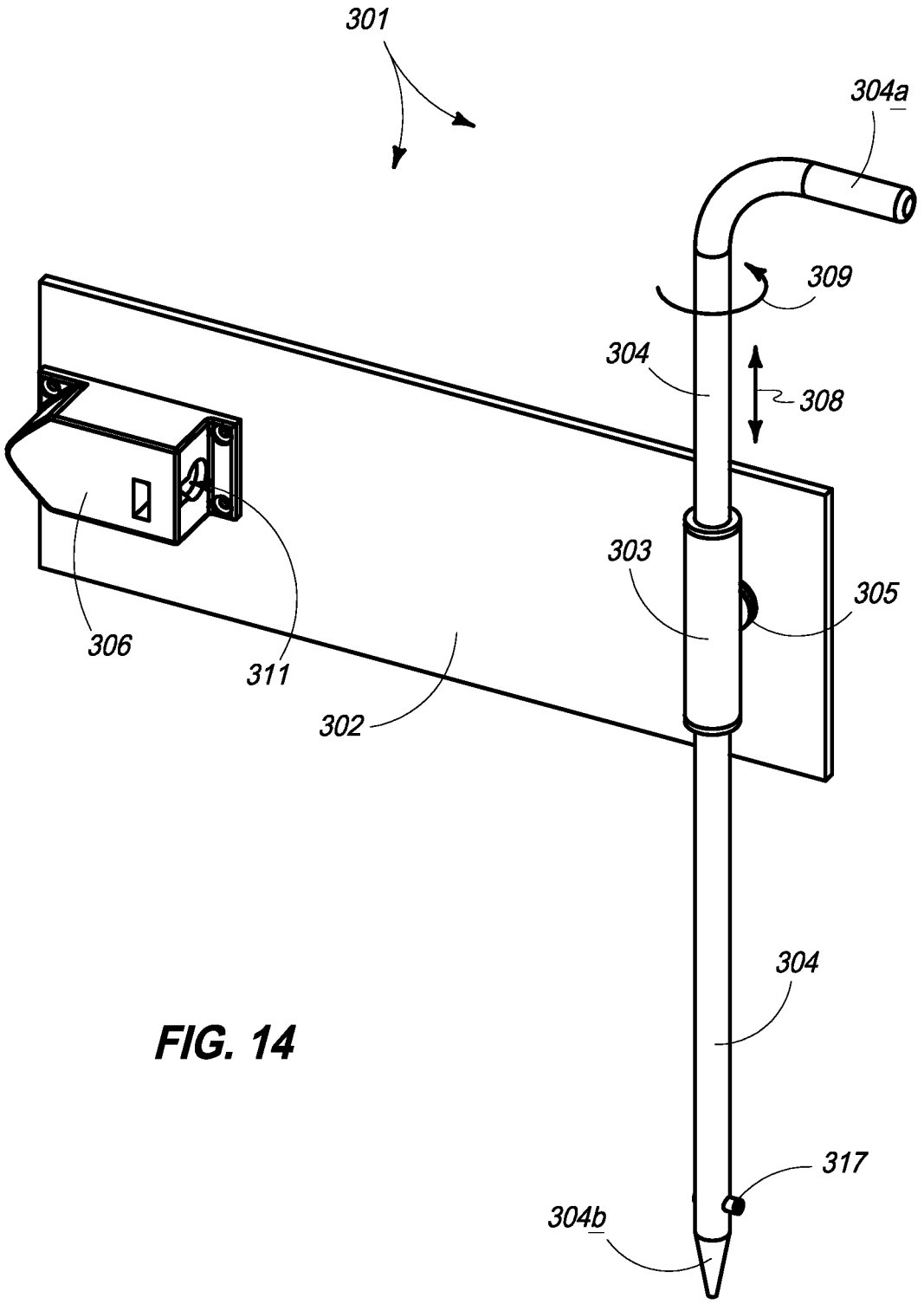
FIG. 14 is a perspective view of one embodiment of an anchor system contemplated by this invention wherein the spike portion is positioned for securing the stretcher, litter or toboggan.

FIG. 14 is a perspective view of one embodiment of an anchor system 301 contemplated by this invention, wherein the spike 304 is positioned for use to secure or anchor the transport device to keep it from moving or shifting. The embodiment of the anchor system illustrated in FIG. 14 shows the general components of a framework 302, a spike 304 contained within spike sleeve 303 which is rotatably mounted to framework 302, and spike seat 306. The spike 304 illustrated in FIG. 14 is rotated to a position where the user may push on handle portion 304*a* of spike 304 to push the pointed portion 304*b* of spike 304 such that it slides through sleeve 303 and forces the pointed portion 304*b* to penetrate into the ice, dirt or other material to which it is to be anchored.

The spike has a bent portion or handle 304*a*, a main body and a piercing, pointed or spike end portion 304*b* for penetrating surfaces (such as dirt, ice, snow pack and others). The spike sleeve 303 is pivotally mounted to framework 302 via pivot 305 such that the spike sleeve 303 (and consequently spike 304) can be rotated 90° relative to framework 302 (or relative to a transport device framework) from the position shown in FIG. 14 to allow the spike 304 then be inserted into spike seat 306, as shown in FIG. 2 (which may be referred to as the stored or transport position of spike 304, with the pointed portion 304*b* being inserted into the spike seat 306. FIG. 14 further illustrates stop 317 attached to spike to prevent the spike 304 from sliding out of spike sleeve 303. The stop 317 in this embodiment is a peg, stub or nub, tooth, or which may also be a screw inserted in or through spike 304.

Figure 15:
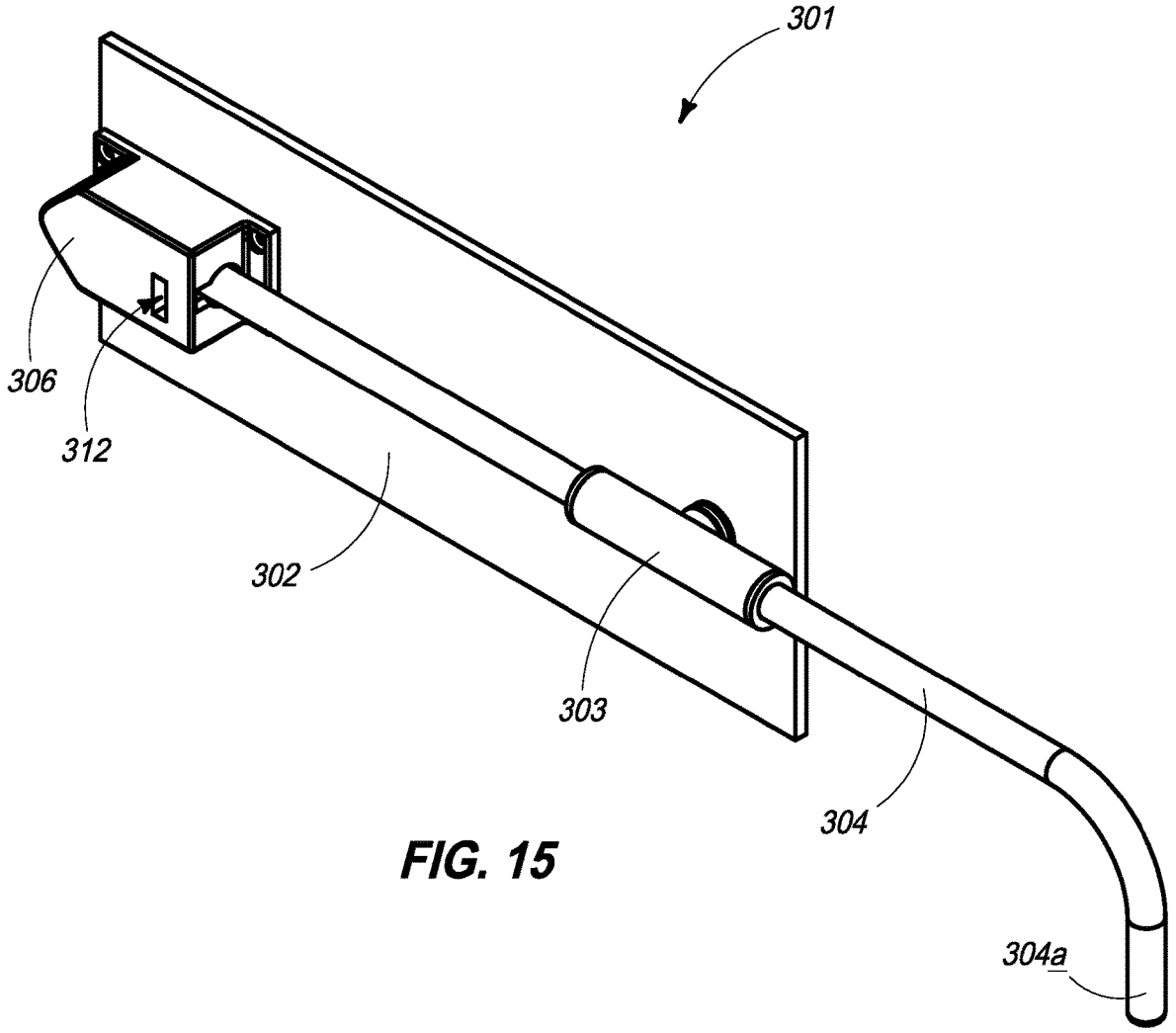
FIG. 15 is a perspective view of one embodiment of an anchor system contemplated by this invention wherein the spike is positioned for storage and/or transport.

It should be noted that the stop 317 provided in the configuration shown in this embodiment of the invention may serve a dual purpose of preventing the spike 304 from sliding out of spike sleeve 303, and as shown in FIG. 15, also being used as a stop mechanism to secure the spike within spike seat 306 (as more fully disclosed and discussed below relative to FIG. 15). FIG. 14 illustrates spike seat aperture 311 which is generally configured to correspond to the cross-section of spike 304 such that spike 304 may be inserted within spike seat aperture 311. It should also be noted that the stop 317 may also be referred to as a tooth or bit, like a tooth or bit on a skeleton key.

It should be noted that embodiments of this invention may include a separate framework such as framework 302 attaching the spike seat 306 and pivotally mounting spike sleeve 303, or this invention may utilize part of the transport device as the framework and attach the spike seat 306 and the spike sleeve 302 directly to the transport device (such as a toboggan, litter or other transport device), all within the contemplation of this invention. In the embodiments where a framework 302 is separately provided, it may provide better rigidity, a better mounting surface, more consistent spacing for mounting of the spike seat and the spike sleeve, and other benefits even though it is not required to practice embodiments of this invention.

FIG. 14 also illustrates how spike 304 is rotatably contained within sleeve 303 with the rotation represented by arrow 309, and slidably contained within sleeve 303, represented by arrow 308.

FIG. 15 is a perspective view of the embodiment of the anchor system shown in FIG. 14, wherein the spike sleeve (and consequently the spike) has been rotated approximately 90° clockwise such that the spike 304 may be slid through spike sleeve 303 until the pointed or spike end portion 304*b* of the spike 304 is inserted into a spike receiving aperture within spike seat 306. While FIG. 15 shows a bent portion on spike 304 which would comprise a handle portion 304*a*, it should be noted that any one of a number of different handle portions may be utilized with spike 304 to better facilitate sliding it through spike sleeve 303, inserting it into spike seat 306 or inserting or forcing the pointed or spike end portion 304*b* into the ice or ground.

FIG. 15 further illustrates that the aperture within the spike seat includes a spike stop aperture portion 312 which would be configured to allow spike stop 317 (shown in FIG. 14) to be inserted with the spike end portion 304*b* of the spike into spike seat 306. As can be seen in a later figure, once the spike stop 317 is inserted into the spike stop aperture portion 312 far enough, the entire spike 304 may be rotated downward such that spike stop 317 (shown in FIG. 14) within spike seat 306 rotates so that it may no longer be removed through the spike stop aperture portion 312. This rotation thereby prevents spike 304 from sliding out of spike seat 306 (by rotating spike 304) until desired by the rescue personnel to utilize the pointed portion 304*b* of the spike to again secure the transport device to the ground or to some other surface such as ice. This configuration which utilizes a spike stop 317 (shown in FIG. 14) toward or at the spike end portion 304*b*, provides a dual securing function of both securing the spike 304 within spike sleeve 303, and also securing the spike 304 within spike seat 306. The spike aperture in this embodiment of the invention, assumes a keyhole type shape, as better illustrated for example in FIG. 16.

Figure 16:
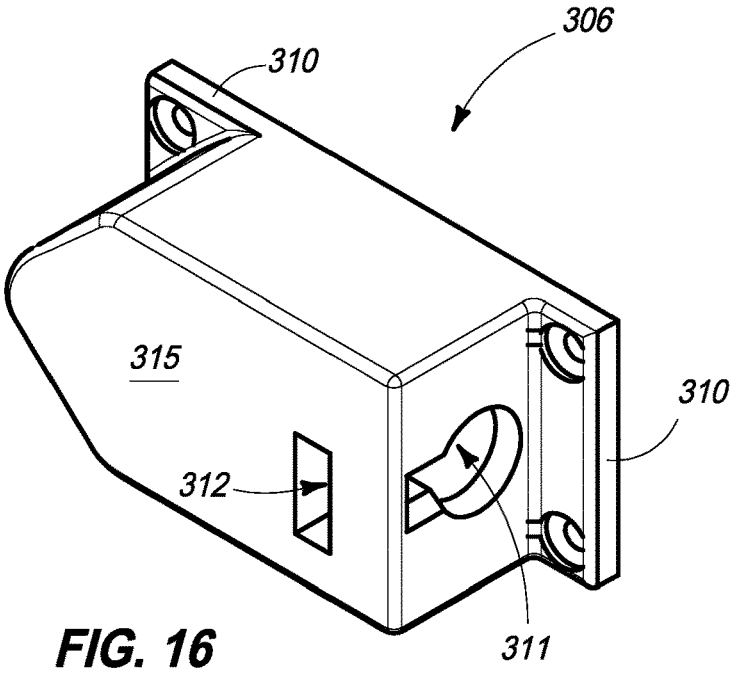
FIG. 16 is a perspective view of one embodiment of a spike seat or housing which may be used in embodiments of this invention to place the spike during storage and/or transportation.

FIG. 16 is a perspective view of one embodiment of a spike housing or spike seat 306, which may be used in embodiments of this invention to place and secure the pointed portion 304*b* of spike 304 during storage and/or transportation. FIG. 16 illustrates one embodiment of a spike seat 306, which may include housing 315, spike aperture 311 with spike stop aperture portion 312, and base 310 for attachment to a framework or directly to a transport device. The base 310 may include fastener apertures through which fasteners may be utilized to attach the spike seat 306 to a framework or directly to the transport device such as a toboggan.

FIG. 16 also shows the possible keyhole type shape of the spike aperture 311 in the spike seat 306, with a round portion and a spike stop aperture portion 312. Older lock type keys generally included a shaft and what is sometimes referred to as a flag, tooth or bit portion of the key—which in this case would correspond to the stop portion 317 (shown in FIG. 14) of the spike 304.

It should be noted that once the spike is inserted in the spike seat 306 and the spike stop 317 is rotated downwardly, the spike is essentially secured from movement in all six directions, even in cases where the spike sleeve 303 fails.

Figure 17:
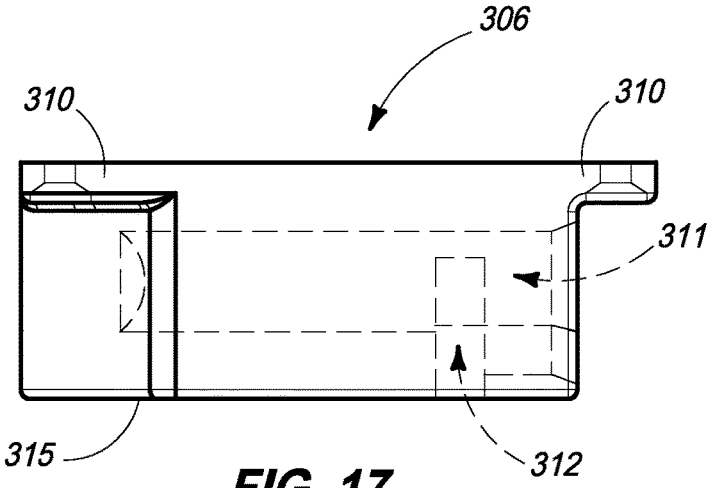
FIG. 17 is an elevation view of the embodiment of the spike seat housing illustrated in FIG. 16.

FIG. 17 is an elevation view of the embodiment of the spike seat 306 or housing illustrated in FIG. 16, showing spike seat housing 315, base 310, and spike aperture 311.

Figure 18:
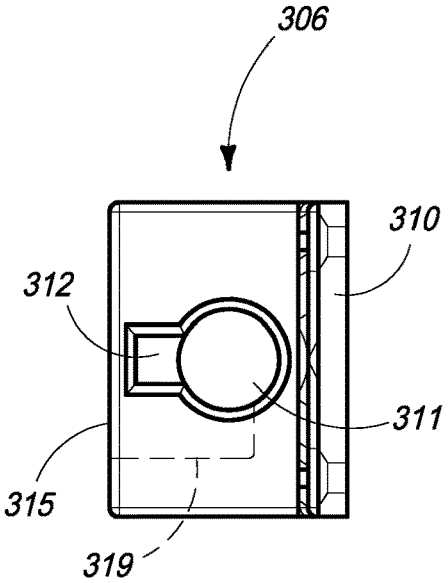
FIG. 18 is an end view of the example of the spike seat shown in FIGS. 16 and 17, which may be utilized in practicing some embodiments of this invention.

FIG. 18 is an end view of the example of the spike seat 306 shown in FIGS. 16 and 17, which may be utilized in practicing some embodiments of this invention showing spike seat housing 315, base 310, spike aperture 311 and spike stop portion aperture 312. FIG. 18 shows hidden lines 319 which partly define the spike stop cavity in the spike seat 306. Once the spike stop (shown as item 317 in FIG. 14) is aligned so that the spike 304 may be inserted into the spike seat 306, then the spike 304 may be rotated (counter-clockwise in the embodiment shown) so that the spike stop prevents the spike from being slid back out of the spike seat 306 until and unless the spike is rotated back clockwise (preferably by the operator) to align the spike stop with the spike stop aperture portion 312 of the spike aperture 311. The spike stop cavity 319 therefore retains or secures the spike within the spike seat 306 due to the spike stop or flag (shown in other figures) being rotated into the spike stop cavity 319 within the spike seat 306.

It should be noted that while the embodiment of the invention illustrated shows the components mounted to a framework 302, this invention is not so limited and may also include embodiments wherein the other components are mounted directly to or integral with a transport device such as a toboggan, all within the contemplation of this invention. For example spike seat 306 may be independently mounted to a toboggan, and similarly the spike sleeve 303 may be rotatably mounted to a toboggan or transport device at a desired distance spaced apart from the spike seat to allow similar operation to that shown and described above. In some embodiments a framework of some sort may be utilized so that it can easily be mounted to any one or more transport devices.

Figure 19:
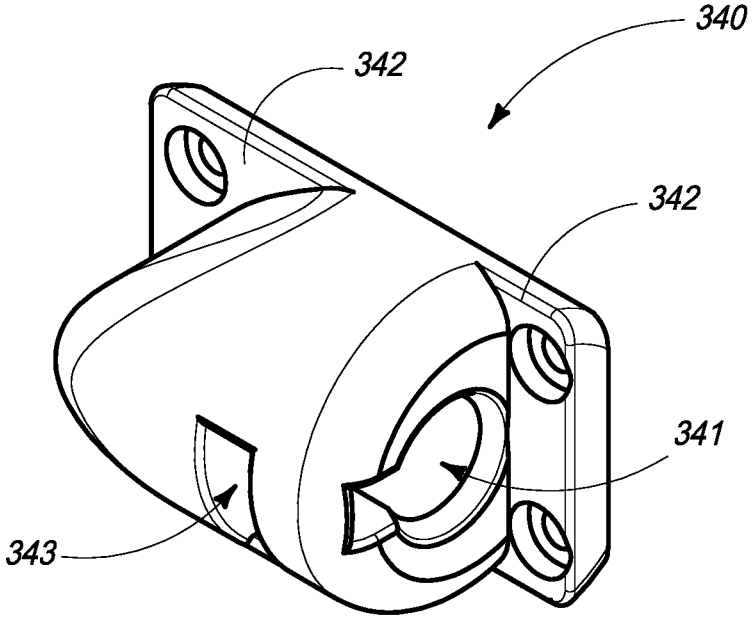
FIG. 19 is a perspective view of another example of an embodiment of a spike seat or housing which may be used in embodiments of this invention to place the spike during storage and/or transportation.

FIG. 19 is a perspective view of another example of an embodiment of a spike seat 340 or housing which may be used in embodiments of this invention to place the spike 304 (shown in other figures) during storage and/or transportation. FIG. 19 illustrates another embodiment of a spike seat 340, which may include spike aperture 341 with spike stop aperture portion 343, and base 342 for attachment to a framework or directly to a transport device. The base 342 may include fastener apertures through which fasteners may be utilized to attach the spike seat 340 to a framework or directly to the transport device such as a toboggan.

Figure 20:
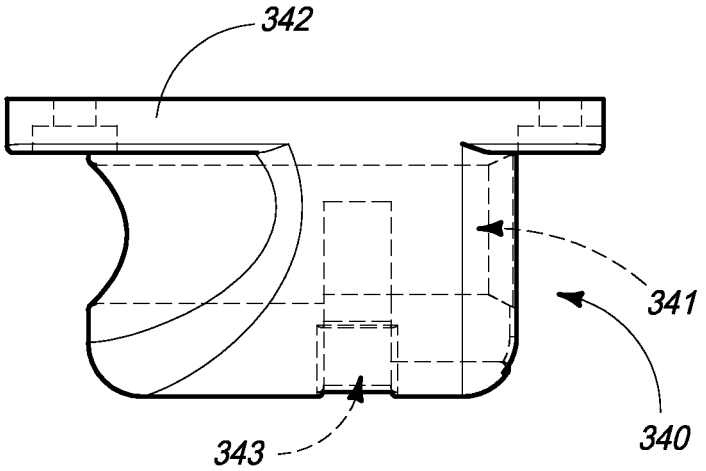
FIG. 20 is an elevation view of the embodiment of the spike seat housing illustrated in FIG. 19.

FIG. 20 is an elevation view of the embodiment of the spike seat housing 340 illustrated in FIG. 19 showing base 342, and spike aperture 341.

As will be appreciated by those of reasonable skill in the art, there are numerous embodiments to this invention, and variations of elements, components and combinations, which may be used, all within the scope of this invention.

In an overall combined embodiment for example, a portable patient transportation device is provided which comprises: an adjustable handle system; a handle attachment and detachment system; and an anchor system for releasably securing a patent transportation device from moving.

One embodiment of this invention, for example, is an adjustable handle system for portable patient transportation devices comprising: a patient transportation device; a handle framework with a first end configured for interaction with a user and a second end which is pivotably mounted to the patient transportation device, the handle framework including at least one stud protruding therefrom; a handle lock framework with a first end pivotally mounted to the patient transportation device, the handle lock framework including a plurality of stud apertures each configured to receive the at least one stud on the handle framework, with each stud aperture being positioned up the handle lock framework progressively away from the patient transportation device; such that positioning the at least one stud in progressively further stud apertures secures the handle framework in different higher positions for use.

A further embodiment to that disclosed in the preceding paragraph may further comprise a spring mounted on the handle lock framework providing a biasing force on the handle lock framework toward the patient transportation device handle and/or two studs horizontally spaced on the handle framework and corresponding to sets of two stud apertures in the handle lock framework.

In another embodiment of the invention, disclosed is a method for providing an adjustable handle system for portable patient transportation devices comprising: providing a patient transportation device; providing a handle framework with a first end configured for interaction with a user and a second end which is pivotably mounted to the patient transportation device, the handle framework including at least one stud protruding therefrom; providing a handle lock framework with a first end pivotally mounted to the patient transportation device, the handle lock framework including a plurality of stud apertures each configured to receive the at least one stud on the handle framework, with each stud aperture being positioned up the handle lock framework progressively away from the patient transportation device; and positioning the at least one stud in a pre-determined one of the stud apertures to secure the handle framework at a pre-determined position for use.

In other and further embodiments to that disclosed in the preceding paragraph, a method may further provide such as an adjustable handle system: wherein the pre-determined one of the stud apertures is a first stud aperture and the pre-determined position for use is a first pre-determined position for use; pivoting the handle lock framework and thereby removing the at least one stud from the first stud aperture; pivoting the handle framework to allow insertion of the at least one stud into a second stud aperture in the handle lock framework; and then inserting the at least one stud in the second stud aperture, thereby securing the handle framework at a second pre-determined position for use.

In still another and further embodiment to that disclosed in the second preceding paragraph, a method may further provide such an adjustable handle system: further wherein the at least one stud provided is two studs horizontally spaced on the handle framework and corresponding to sets of two stud apertures in the handle lock framework; and/or further wherein a spring is provided mounted on the handle lock framework providing a biasing force on the handle lock framework toward the patent transportation device handle.

In another embodiment of this invention, for example, a removable handle system is provided for portable patient transportation devices comprising: a handle with a first end configured for interaction with a user and a second end which terminates in a handle adapter; the handle adapter comprising a perimeter with an attachment bar gap in the perimeter, the perimeter generally defining an internal cavity; an attachment bar device framework configured at a first end for mounting to a portable patient transportation device and to which an attachment bar is mounted; and the internal cavity of the handle adapter is sized and configured to receive and pivot about the attachment bar when in attached positions, and the attachment bar gap in the handle adapter is configured for passage of the attachment bar into the internal cavity when in a removal position.

A further embodiment to that disclosed in the preceding paragraph may further be wherein the handle adapter is generally circular in shape.

In another embodiment of the invention, disclosed is a method for the attachment, use and removal of a handle to a portable patient transportation device, comprising: providing a handle with a first end configured for interaction with a user and a second end which terminates in a handle adapter; providing the handle adapter such that it comprises a perimeter with an attachment bar gap in the perimeter, the perimeter generally defining an internal cavity; providing an attachment bar device framework configured at a first end for mounting to a portable patient transportation device and to which an attachment bar is mounted; providing the internal cavity of the handle adapter such that it is sized and configured to receive and pivot about the attachment bar when in attached positions, and the attachment bar gap in the handle adapter is configured for passage of the attachment bar into the internal cavity when in a removal position; placing the attachment bar gap in its insertion/removal position over the attachment bar; placing the attachment bar into the internal cavity of the handle adapter; pivoting the handle about the attachment bar to a use position; pivoting the handle about the attachment bar back to its insertion/removal position; and removing the handle adapter by removing the attachment bar from the internal cavity of the handle adapter.

In a further embodiment to that method disclosed in the preceding paragraph, the method may be further wherein the insertion/removal position of the handle adapter is at a location where the handle adapter is aligned with the attachment bar gap such that the attachment bar can be inserted into or removed from the internal cavity by moving the handle adapter.

In another embodiment of this invention, for example, is an anchor system for use in combination with a toboggan, rescue stretcher or rescue litter, comprising: a spike sleeve configured to be rotatably mounted directly or indirectly to a toboggan, rescue stretcher or rescue litter; a spike slidably and rotatably contained within the spike sleeve, the spike including a spike end portion including a spike stop in the spike end portion; providing a spike seat configured to be mounted directly or indirectly to the toboggan, rescue stretcher or rescue liter, the spike seat including a spike seat housing with a spike keyhole aperture including a spike stop aperture portion; the spike aperture being configured in the spike seat such that when the spike with spike stop is inserted into the spike seat and rotated into its secured position, the spike is in its secured position; the spike sleeve being configured such that when it is rotated to a vertical position it facilitates the spike to slide downward into the ground surface and thereby secures the toboggan, rescue stretcher or rescue liter; and further configured such that when the spike sleeve is in a substantially horizontal position, it facilitates the spike and spike stop sliding into the spike seat, thereby securing the spike end of the spike.

A further embodiment to that disclosed in the preceding paragraph is further wherein the spike includes a handle portion at an end opposite the spike end portion.

In a further embodiment of this invention, a method of anchoring a toboggan, rescue stretcher or rescue liter is provided, comprising the following: providing a spike sleeve rotatably mounted directly or indirectly to a toboggan, rescue stretcher or rescue liter; providing a spike slidably and rotatably contained within the spike sleeve, the spike including a spike end portion including a spike stop in the spike end portion; providing a spike seat mounted to the toboggan, rescue stretcher or rescue liter, the spike seat including a spike seat housing with a spike keyhole aperture including a spike stop aperture portion; inserting the spike into the spike seat and rotating the spike into its secured position such that the spike stop rotates within the spike seat to restrict movement of the spike in its secured position; rotating the spike stop into its release position (which in the embodiment shown is wherein the spike stop is horizontally oriented so it can slide through the keyhole aperture), sliding the spike longitudinally within the spike sleeve thereby sliding the spike out of the spike seat; rotating the spike and spike sleeve to a vertical position; and sliding the spike downward such that the spike is secured into a ground surface, thereby securing the toboggan, rescue stretcher or rescue liter.

In a further embodiment to that disclosed in the preceding paragraph, a method of anchoring a toboggan, rescue stretcher or rescue liter is provided additionally comprising: sliding the spike upward in the spike sleeve to withdraw it from being secured in the ground; rotating the spike and spike sleeve back to a position adjacent the spike seat; sliding the spike within the spike sleeve to insert it into the spike aperture in the spike seat; and rotating the spike within the spike sleeve to place the spike stop in its secured position within the spike seat.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A portable patient transportation device comprising:

an adjustable handle system;

a handle attachment and detachment system configured such that a handle of the patient transportation device may be attached and detached without the use of a tool;

an anchor system for releasably securing a patent transportation device from moving; and wherein the adjustable handle system is further comprised of;

a handle framework with a first end configured for interaction with a user and a second end which is pivotably mounted to the patient transportation device, the handle framework including at least one stud protruding therefrom;

a handle lock framework with a first end pivotally mounted to the patient transportation device, the handle lock framework including a plurality of stud apertures, each configured to receive the at least one stud on the handle framework, with the plurality of stud apertures being positioned up the handle lock framework progressively away from the patient transportation device; such that positioning the at least one stud in progressively further stud apertures secures the handle framework in different higher positions for use.

2. A portable patient transportation device comprising:

an adjustable handle system;

a handle attachment and detachment system; and an anchor system for releasably securing a patent transportation device from moving, wherein the anchor system is further comprised of:

a spike sleeve configured to be rotatably mounted directly or indirectly to a toboggan, rescue stretcher or rescue liter;

a spike slidably and rotatably contained within the spike sleeve, the spike including a spike end portion including a spike stop in the spike end portion;

providing a spike seat configured to be mounted directly or indirectly to the toboggan, rescue stretcher or rescue liter, the spike seat including a spike seat housing with a spike keyhole aperture including a spike stop aperture portion;

the spike aperture being configured in the spike seat such that when the spike with spike stop is inserted into the spike seat and rotated into its secured position, the spike is in its secured position;

the spike sleeve being configured such that when it is rotated to a vertical position it facilitates the spike to slide downward into the ground surface and thereby secures the toboggan, rescue stretcher or rescue liter; and further configured such that when the spike sleeve is in a substantially horizontal position, it facilitates the spike and spike stop sliding into the spike seat, thereby securing the spike end of the spike.

3. An adjustable handle system for portable patient transportation devices as recited in claim 2, and further comprising a spring mounted on the handle lock framework providing a biasing force on the handle lock framework toward the patent transportation device handle.

4. An adjustable handle system for portable patient transportation devices as recited in claim 2, and further wherein there are two studs horizontally spaced on the handle framework and corresponding to sets of two stud apertures in the handle lock framework.

5. A removable handle system for portable patient transportation devices as recited in claim 2, and further wherein the handle adapter is generally circular in shape.

6. An anchor system for use in combination with a toboggan, rescue stretcher or rescue liter as recited in claim 4, and further wherein the spike includes a handle portion at an end opposite the spike end portion.

7. A portable patient transportation device comprising:

an adjustable handle system comprising:

a handle framework with a first end configured for interaction with a user and a second end which is pivotably mounted to the patient transportation device, the handle framework including at least one stud protruding therefrom;

a handle lock framework with a first end pivotally mounted to the patient transportation device, the handle lock framework including a plurality of stud apertures, each configured to receive the at least one stud on the handle framework, with the plurality of stud apertures being positioned up the handle lock framework progressively away from the patient transportation device;

such that positioning the at least one stud in progressively further stud apertures secures the handle framework in different higher positions for use;

a handle attachment and detachment system comprising:

a handle with a first end configured for interaction with a user and a second end which terminates in a handle adapter;

the handle adapter comprising a perimeter with an attachment bar gap in the perimeter, the perimeter generally defining an internal cavity;

an attachment bar device framework configured at a first end for mounting to a portable patient transportation device and to which an attachment bar is mounted; and the internal cavity of the handle adapter is sized and configured to receive and pivot about the attachment bar when in attached positions, and the attachment bar gap in the handle adapter is configured for passage of the attachment bar into the internal cavity when in a removal position; and an anchor system for releasably securing a patent transportation device from moving, the anchor system comprising:

a spike sleeve configured to be rotatably mounted directly or indirectly to a toboggan, rescue stretcher or rescue liter;

a spike slidably and rotatably contained within the spike sleeve, the spike including a spike end portion including a spike stop in the spike end portion;

providing a spike seat configured to be mounted directly or indirectly to the toboggan, rescue stretcher or rescue liter, the spike seat including a spike seat housing with a spike keyhole aperture including a spike stop aperture portion;

the spike aperture being configured in the spike seat such that when the spike with spike stop is inserted into the spike seat and rotated into its secured position, the spike is in its secured position;

the spike sleeve being configured such that when it is rotated to a vertical position it facilitates the spike to slide downward into the ground surface and thereby secures the toboggan, rescue stretcher or rescue liter; and further configured such that when the spike sleeve is in a substantially horizontal position, it facilitates the spike and spike stop sliding into the spike seat, thereby securing the spike end of the spike.

* * * * *